US005483888A

United States Patent [19]

Greive

[11] Patent Number: 5,483,888

[45] Date of Patent: Jan. 16, 1996

[54] DEVICE FOR ACTUATING LATERAL SHEET GUIDES IN ROTARY PRINTING PRESSES

[75] Inventor: Martin Greive, Heidelberg, Germany

[73] Assignee: Heidelberger Druckmaschinen AG, Heidelberg, Germany

[21] Appl. No.: 289,693

[22] Filed: Aug. 12, 1994

[30] Foreign Application Priority Data

Aug. 12, 1993 [DE] Germany ..... 43 27 012.3

[51] Int. Cl.[6] ..... B41F 13/24

[52] U.S. Cl. ..... 101/232; 271/240; 271/228

[58] Field of Search ..... 101/232, 240, 101/279, 225, 228; 271/3, 171, 253, 254, 240; 226/199; 400/633, 638.1, 633.2

[56] References Cited

U.S. PATENT DOCUMENTS

| | | | |
|---|---|---|---|
| 3,311,371 | 3/1967 | Zeuthen | 271/240 |
| 3,589,710 | 6/1971 | Yagi et al. | 271/9 |
| 4,750,660 | 6/1988 | Kamimura | 226/199 |

FOREIGN PATENT DOCUMENTS

| | | |
|---|---|---|
| 1102768 | 10/1961 | Germany . |
| 3321724 | 3/1984 | Germany . |
| 8514473 | 8/1985 | Germany . |
| 8514473.8 | 9/1985 | Germany . |
| 243257 | 2/1987 | Germany . |
| 4100901 | 7/1992 | Germany . |

*Primary Examiner*—Chris A. Bennett
*Attorney, Agent, or Firm*—Herbert L. Lerner; Laurence A. Greenberg

[57] ABSTRACT

A device for actuating lateral sheet guides in accordance with respective sheet format widths to be processed includes an actuator disposed on an operating side of a rotary printing press for displacing a side stop transversely to the longitudinal direction of a sheet, the actuator being disposed so as to be visible and freely accessible on an operating side of a sheet pile, adjustable lateral sheet guides disposed in a feed region and a delivery region of the printing press, mutually cooperating tensioning devices form-lockingly connected to the actuator and to the lateral sheet guides and being simultaneously adjustable by the actuator in the feed region and in the delivery region symmetrically to a center of a printing unit of the printing press.

5 Claims, 4 Drawing Sheets

DEVICE FOR ACTUATING LATERAL SHEET GUIDES IN ROTARY PRINTING PRESSES

The invention relates to a device for actuating lateral sheet guides in a rotary printing press in accordance with respective sheet format widths to be processed, the device having an actuator disposed on the control or operating side of the press for displacing a side stop transversely to the longitudinal direction of the sheet, and tensioning means extending to an actuator disposed so as to be visible and freely accessible on the control or operating side of a sheet pile, the tensioning means and the sheet-pile actuator being form-lockingly connected to one another. In this regard, it is noted that a form-locking connection connects two elements together due to the shape of the elements themselves, as opposed to a force-locking connection which locks the elements together by force external to the elements.

From the state of the prior art represented in the published German Patent Document DE 41 00 901 A1 of a well known printing press manufacturer, it is apparent that a method for prestacking a sheet pile in a sheet feeder of rotary printing presses is already known. Stops on two spindles, which are respectively movable via a separately assigned actuator, are moved a given distance laterally away from the feed pile and, after the prestacking is completed, are moved back towards the feed pile again, in order to facilitate the prestacking process. The lateral position of the sheet pile is monitored by means of a scanner device. A disadvantage of this conception is that, starting from the provided electromotively realized spindle drives, it is shortsighted not to realize other control components in the concept from the outset.

The published German Patent Document DE 33 21 724 C1 discloses a sheet feeder in rotary printing presses of the same manufacturer. By means of freely movable guide rails provided in a forward region of the sheet pile, a free lateral movement with minimal expenditure of force and gentle handling of the sheets to be printed are possible.

German Patent DE-PS 1 102 768 discloses a sheet-fed printing press with a feed table and feed rails. By means of two positioning heads, shafts which carry a cable drum on respective rear ends thereof are rotatable. Tabs which move respective side bearing rails are secured to cables revolving on these cable drums. The side bearing rails extend through the pile wall and are axially movable within a respective recess. This state-of-the-art configuration again relates exclusively to a feed region of a sheet-fed printing press.

Finally, German Utility Model G 85 14 473.8 U1 discloses a device for variably adjusting a side stop for sheet piles in a sheet pile feeder. Via a guided tooth belt deflected at the sheet feeder frame, a side stop is displaceable transversely to the longitudinal direction of the sheets and is conformable to the respective sheet-format width to be processed. A form-locking connection exists between an actuator which is disposed so as to be freely accessible and the tensioning means which displaces the side stop.

The constructions in the state of the prior art outlined above have the disadvantage that the operations of conforming or adapting to various sheet formats to be processed relate only to the feed region although, upon a format change, adjustments must also be made at the sheet delivery which, rather inconsistently, are not taken into account at all in the state-of-the-art constructions.

In view of the foregoing disadvantages of the prior art, it is accordingly an object of the invention to provide a device for actuating lateral sheet guides in rotary printing presses wherein the necessary conforming or adaptation operations for sheet guidance, when a format change occurs, is effected for the entire machine from one control point.

With the foregoing and other objects in view, there is provided, in accordance with the invention, in a rotary printing press having a printing unit, a feed region and a delivery region, a device for actuating lateral sheet guides in accordance with respective sheet format widths to be processed, comprising an actuator disposed on an operating side of the press for displacing a side stop transversely to the longitudinal direction of the sheet, the actuator being disposed so as to be visible and freely accessible on an operating side of a sheet pile, adjustable lateral sheet guides disposed in the feed region and the delivery region of the printing press, mutually cooperating tensioning means form-lockingly connected to the actuator and to the lateral sheet guides and being simultaneously adjustable by the actuator in the feed region and in the delivery region symmetrically to a center of the printing unit.

In accordance with another feature of the invention, a central spindle is connected to the actuator so as to be adjustable thereby, and a plurality of adjusting spindles are connected by the tensioning means to the central spindle so as to be rotatable thereby.

In accordance with a further feature of the invention, each of the central spindle and the plurality of adjusting spindles is formed with a right-hand and a left-hand thread.

In accordance with an added feature of the invention, one of the plurality of adjusting spindles is axially adjustable, and the lateral sheet guides include lateral pile guides which are positionable exactly with respect to an impression cylinder of the printing unit by an axial adjustment of the one adjusting spindle.

In accordance with a concomitant feature of the invention, the device includes stacking aids for the sheet pile, and means for adjusting the stacking aids at the sheet pile parallel to the lateral sheet guides.

An advantage of the construction according to the invention is that the lateral sheet guides are each adjustable by a like amount with respect to the press center. Tedious separate adjustments in the feeder and in the delivery can thus be omitted. Pressmen need not make any adjustments in the poorly accessible delivery region; the ergonomically favorable disposition of the actuator assures the possibility of effecting a central adjustment from a control station. The standardized parts used as tensioning means are inexpensive, virtually maintenance-free, and have high operating safety and reliability over long service lives.

Moreover, the construction according to the invention offers the advantage of a considerable savings in setup time when a change of job and format is required, because all of the lateral sheet guides can be adjusted centrally and simultaneously from one control point. Because of the realization of the concept of the invention that the adjusting spindles be rotatable via the tensioning means by a central spindle which is adjustable by the actuator, and that each of the spindles be formed with a right-hand and a left-hand thread, it is advantageously possible to adjust the position of the lateral sheet guides to the respective format widths to be processed. Moreover, provision is made for adjusting the lateral pile guides exactly with respect to an impression cylinder of the printing unit by means of axial displacements of the adjusting spindle. The individual sheets can accordingly be transferred to the impression cylinder with virtually optimal alignment.

Other features which are considered as characteristic for the invention are set forth in the appended claims.

Although the invention is illustrated and described herein as embodied in a device for actuating lateral sheet guides in rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
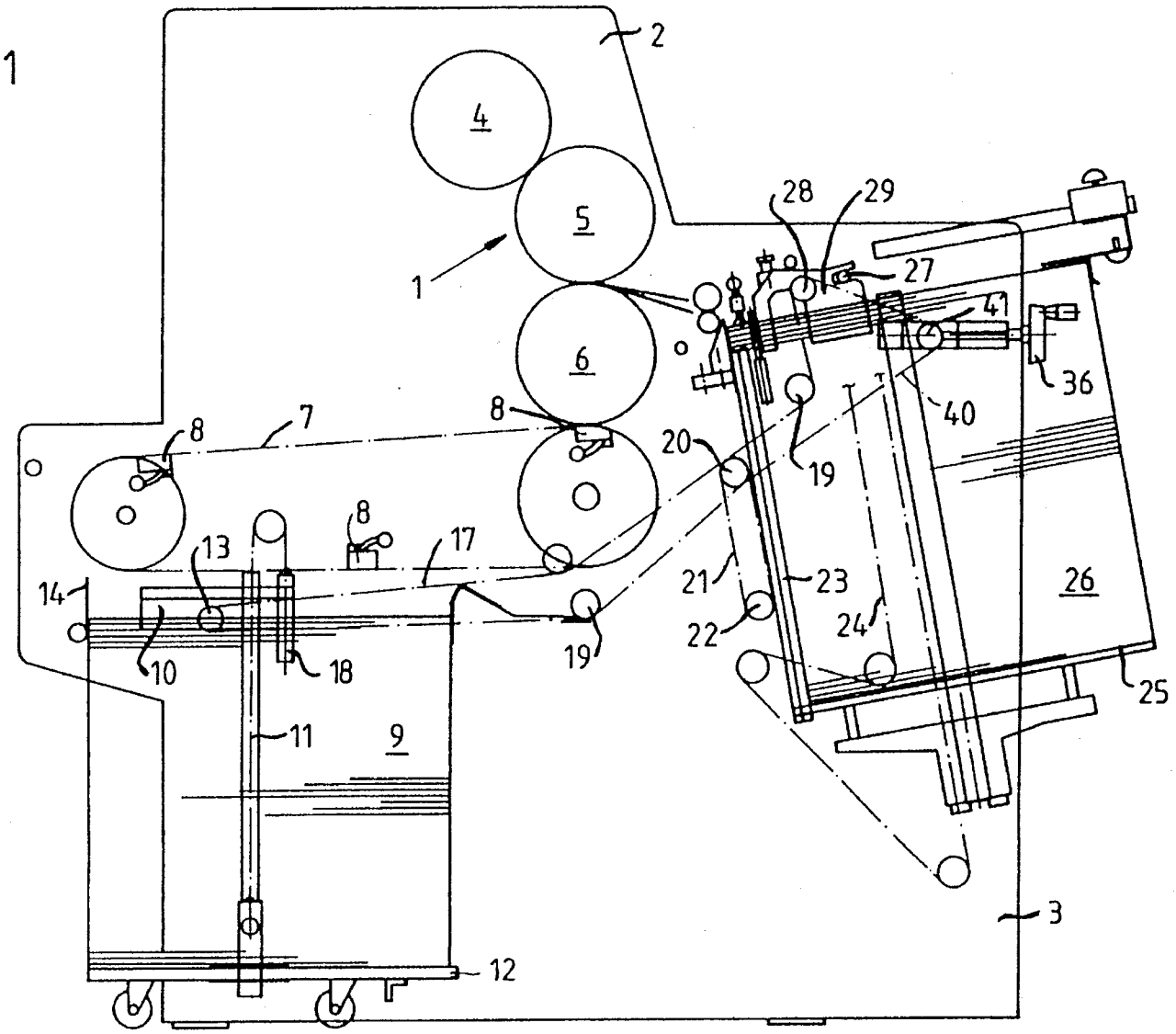
FIG. 1 is a diagrammatic side elevational view of a rotary printing press provided with the device for actuating lateral sheet guides according to the invention.

Referring now to the drawings and, first, particularly to FIG. 1 thereof, there is shown therein a rotary printing press wherein printing unit cylinders of a printing unit 1 are journalled in printing unit side walls 2. This involves a printing form cylinder 4, a transfer cylinder 5, as well as an impression cylinder 6. Below the impression cylinder 6 is a delivery chain 7 on which individual gripper bars 8 are mounted. The gripper bars 8 deposit the printed sheets on a delivery pile 9; the delivered sheets are brought into an aligned position by joggers 10. The joggers 10, which are applied laterally of the delivery pile 9, are received on a respective spindle 13.

The delivery pile 9 is disposed on a pile support 12, which can be raised and lowered by a lifting chain 11. A counter-weight 18 is secured to one end of the lifting chain 11. A swivelable stop 14 is located at the end of the delivery pile 9 and, accordingly, permits sample or proof sheets to be taken from the pile 9.

The adjusting spindles 13 are actuated via tensioning means 17, such as chains. The chains 17 extend over chain guides 19 to a central spindle 20. Further tensioning means 21, also revolving around the central spindle 20, and which may be constructed as a chain or toothed belt, revolve around an adjusting spindle 22. Stacking or piling aids 23 are axially movably disposed on the spindles 20 and 22. The feed pile 26 resting on a pile support 25 is movable upwards and downwards via a lifting chain 24.

Further tensioning means 40, for example, in the form of a chain, revolve around the central spindle 20 and actuate an adjusting spindle 28, on which lateral pile guides 29 are mounted. The tensioning means 40 are actuatable by a hand wheel 36 via an adjusting or control wheel 41 and act upon the central spindle 20.

Figure 2:
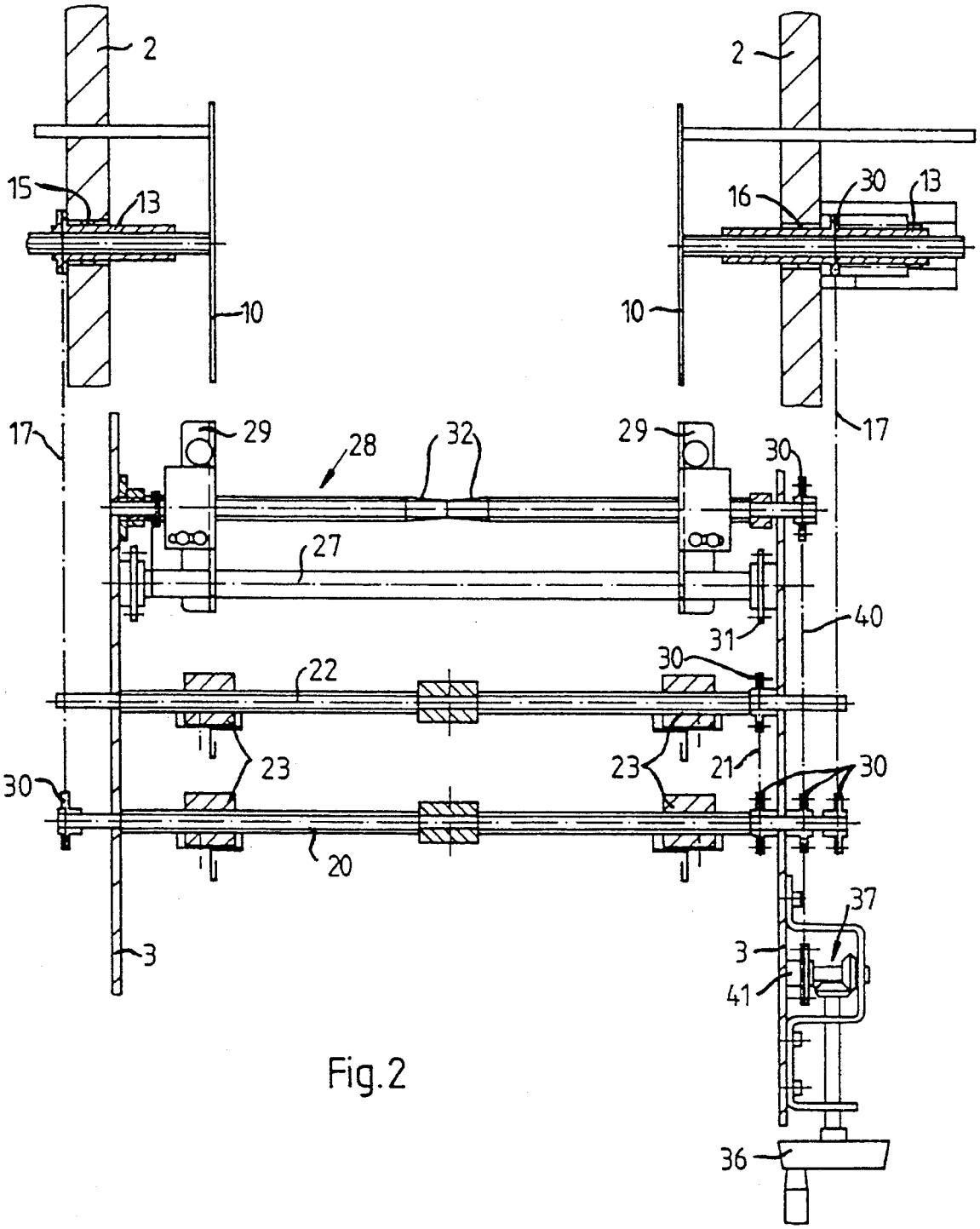
FIG. 2 is an enlarged fragmentary top plan view of FIG.1, with the courses or lengths of the tensioning means between respective rollers being shown folded or developed in the plane of the drawing.

In FIG. 2, the individual spindles together with the lateral sheet guides thereof, as well as the respective courses of the tensioning means, are shown folded or developed into the plane of the drawing.

It should be noted that the spindles 13 illustrated in the upper part of FIG. 2 are journalled in the printing-unit side walls 2, while the central spindle 20 and the adjusting spindles 20, 22 and 28 are journalled in the feeder side walls 3.

A displacement of the lateral sheet guides is effected by rotating the actuator 36 which, via a gear 37, acts upon the control wheel 41, over which the tension means 40, formed as a chain or toothed belt, revolves. The chain 40 moves the central spindle 20, via a middle one of sprocket wheels or toothed disks 30. Via the chain 21, the adjusting spindle 22, which carries the stacking or piling aids 23, is moved by the central spindle 20. As can be seen from FIG. 1, the central spindle 20 and the adjusting spindle 22 are located above one another in the feeder side walls 3.

The tensioning means 40, however, extend parallel to the feeder side wall 3 up to a further adjusting spindle 28. Located on this adjusting spindle 28, which is likewise received or journalled in the feeder side walls 3, are two lateral pile guides 29, which are also movable laterally upon rotation of the adjusting spindle 28.

Finally, mounted on the central spindle 20 is a third sprocket wheel 30 from which the tensioning means 17 extend on both sides of the feeder side walls 3 and the printing-unit side walls 2 up to the adjusting spindles 13. By suitably rotating the spindles 13, the joggers 10 are moved towards and away from the delivery pile 9.

Figure 3:
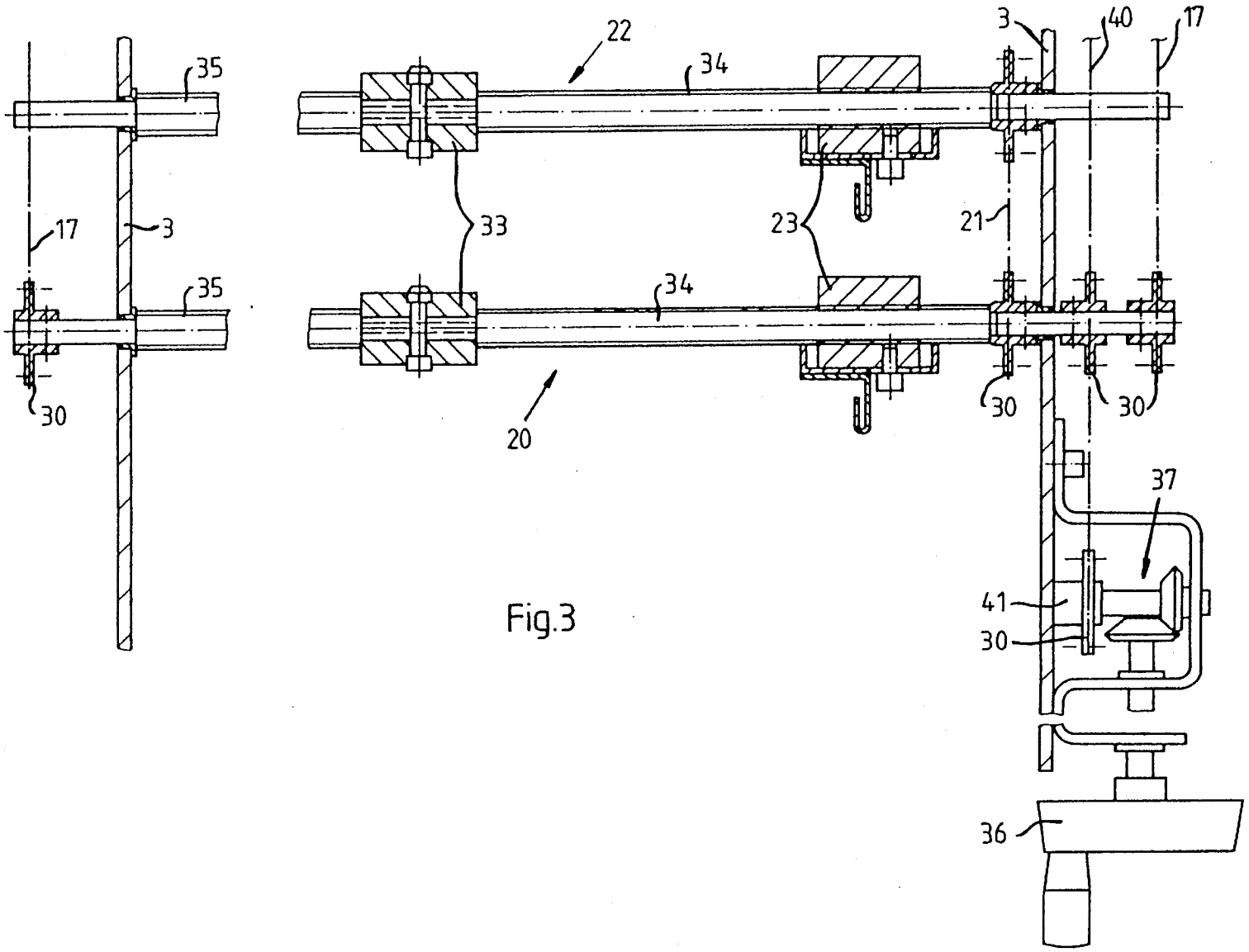
FIG. 3 is a further enlarged fragmentary view of FIG. 2, showing the actuator with a central spindle in greater detail.

FIG. 3 is a fragmentary enlarged plan view of FIG. 2 showing the central spindle 20 and the adjusting spindle 22. The central spindle 20 and the adjusting spindle 22 are each formed of two halves which are joined together by means of a spindle cross 33. The piling or stacking aids 23 are received or mounted on a threaded length 34 of the respective spindles 20 and 22 which has a right-hand thread and a threaded length 35 thereof having a left-hand thread, the threads having the same pitch. It should also be noted that the two spindles 20 and 22 are disposed above one another in the feeder side walls 3. A rotation of the spindles 20 and 22 by the respective tensioning means 21 and 40, respectively, performed from the hand wheel 36, effects a movement of the stacking or piling aids 23 towards or away from one another. The stacking or piling aids 23 on the threaded lengths 34 with the right-hand thread and the stacking or piling aids 23 on the threaded lengths 35 having the left-hand thread, which are not illustrated for reasons of symmetry, respectively travel the same distance in this manner during the displacement and, as a result, an axial displacement oriented symmetrically with respect to the center of the press occurs for both the stacking or piling aids 23 and the lateral pile guides 29, as well as the lateral joggers 10.

Figure 4:
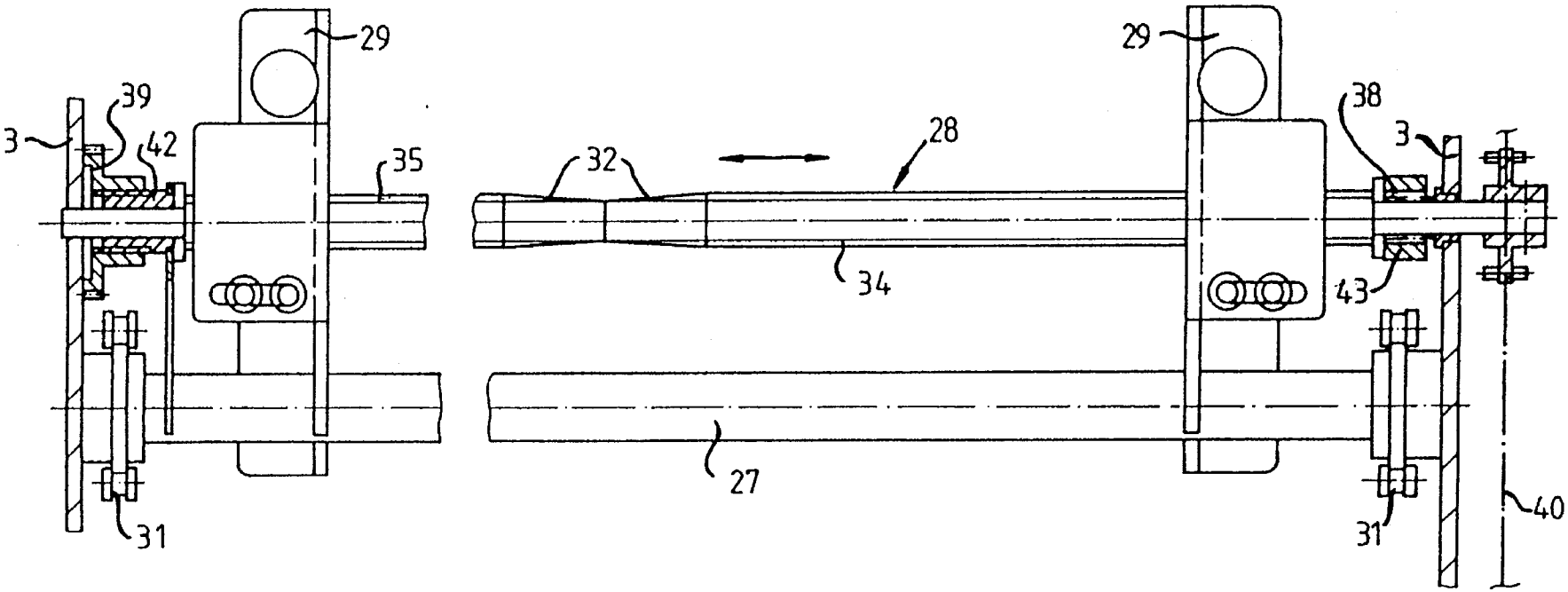
FIG. 4 is another enlarged fragmentary view of FIG. 2, showing the lateral pile guides above the feed pile.

In FIG. 4, an enlarged view of the adjusting spindle 28 together with with the lateral pile guides 29 disposed thereon is shown. The spindle 28 centrally has two thread chamfers or runouts 32. Upon a rotation of the adjusting spindle 28 by the chain 40, the lateral pile guides 29 received or mounted on the threaded lengths 34 and 35 are respectively moved axially a like distance or extent, resulting in a displacement of both pile guides 29 symmetrically to the press center. In FIG. 4, also shown is a crossbar or traverse 27 which is received in the feeder side walls 3. The lifting chain 24, which vertically moves the feed pile 26, revolves on sprocket wheels 31 which are supported on end spindles of the crossbar 27.

A control wheel 39 is received on the feeder side wall 3, concentrically with or coaxial to the adjusting spindle 28. An internal thread of this wheel 39 meshes with a threaded bushing 42 which is formed with an external thread. Depending upon the direction of rotation, the adjusting spindle 28 is adjustable in axial direction on the control wheel 39 via the bushing 42 and counter to the force of a spring 38. The spring 38 is braced at one end thereof against the feeder side wall 3 and at the other end thereof against a bracing disk provided between the right-hand thread 34 and a collar 43. Thus, axial displacements are possible in both of the directions represented by the double-headed arrow in FIG. 4.

In multicolor rotary printing presses, which are structurally of very great length, it is entirely conceivable to provide a pneumatically or electrically operated format adaptation or conformation in the feed or delivery region. In that case, with the inclusion of suitable control components in a central remote control system, it would then be possible to displace stacking or piling aids 23, joggers 10 and lateral pile guides simultaneously.

I claim:

1. In a rotary printing press having a printing unit, a feed region and a delivery region, lateral sheet guides with sheet stops disposed in the printing unit defining sheet format width to be processed, and an operating side at which the printing unit is accessible to a press operator, a device for actuating the lateral sheet guides in accordance with respective sheet format widths to be processed, the device comprising an actuator disposed on the operating side of the press for displacing a side stop transversely to the longitudinal direction of the sheet, said actuator being disposed so as to be visible and freely accessible on an operating side of a sheet pile, adjustable lateral sheet guides disposed in the feed region and the delivery region of the printing press, mutually cooperating tensioning means form-lockingly connected to said actuator and to said lateral sheet guides and being simultaneously adjustable by said actuator in the feed region and in the delivery region for moving said lateral sheet guide symmetrically to a center of the printing unit.

2. Device according to claim 1, comprising a central spindle connected to said actuator so as to be adjustable thereby, and a plurality of adjusting spindles connected by said tensioning means to said central spindle so as to be rotatable thereby.

3. Device according to claim 2, wherein each of said central spindle and said plurality of adjusting spindles is formed with a right-hand and a left-hand thread.

4. Device according to claim 2, including means enabling one of said plurality of adjusting spindles to be axially adjustable, and wherein said lateral sheet guides include lateral pile guides which are positionable exactly with respect to an impression cylinder of the printing unit by an axial adjustment of said one adjusting spindle.

5. Device according to claim 1, including stacking aids for the sheet pile, and means for adjusting said stacking aids at the sheet pile parallel to said lateral sheet guides.

* * * * *